United States Patent [19]

Gueguen

[11] 3,945,015

[45] Mar. 16, 1976

[54] SATELLITE TRACKING ANTENNA HAVING A DISH MOVEABLY SUPPORTED AT THREE POINTS

[76] Inventor: Michel Gueguen, 78160 St-Nom-la-Breteche, France

[22] Filed: Nov. 12, 1974

[21] Appl. No.: 523,149

[30] Foreign Application Priority Data

Nov. 22, 1973 France ..... 73.41648

[52] U.S. Cl. ..... 343/765; 343/766; 343/912

[51] Int. Cl.[2] ..... H01Q 3/08

[58] Field of Search..... 343/765, 766, 912

[56] References Cited

UNITED STATES PATENTS

| | | | |
|---|---|---|---|
| 3,374,977 | 3/1968 | Moy | 343/765 |
| 3,546,704 | 12/1970 | Selby et al. | 343/765 |
| 3,714,660 | 1/1973 | Scrafford et al. | 343/880 |

*Primary Examiner*—Eli Lieberman

*Attorney, Agent, or Firm*—Lewis H. Eslinger; Alvin Sinderbrand

[57] ABSTRACT

This invention relates to the steering of telecommunication antennae, and particularly to the mountings therefor. These mountings are used for supporting an antenna to allow communications to be established with a geostationary satellite i.e., one which is stationary in relation to the earth. The invention provides that the structure associated with the antenna be mounted at three points on the steering mounting, and the latter rests on the ground. That one of these points which is situated at the apex of said structure is provided with a bi-directional joint which allows the antenna to pivot about an axis XX in azimuth and an axis YY in elevation: these axes lying orthogonally to one another in a plane perpendicular to the axis ZZ of the antenna. The bi-directional joint aforementioned is mounted to pivot on the base mounting about the axis ZZ of the antenna itself.

7 Claims, 9 Drawing Figures

Fig. 8
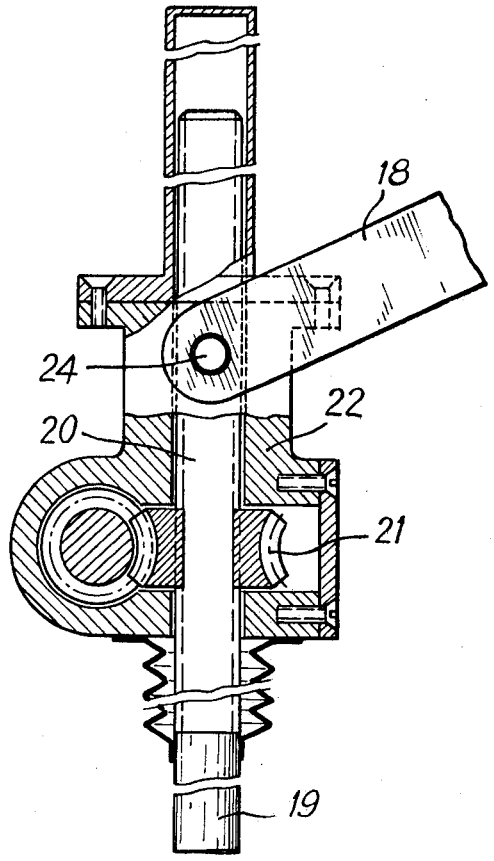
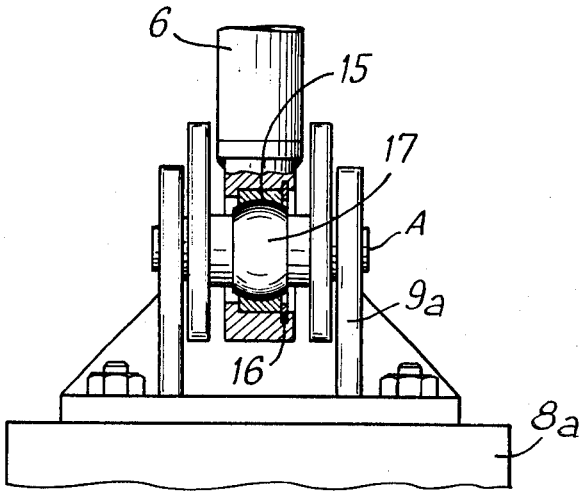
Fig. 7

SATELLITE TRACKING ANTENNA HAVING A DISH MOVEABLY SUPPORTED AT THREE POINTS

BACKGROUND OF THE INVENTION

The present invention relates to mountings for steering telecommunication antennae.

Such mountings are used for supporting a telecommunications antenna which allows communications to be established with a satellite which is stationary in relation to the earth, and it is an object of the invention to provide such mounting which will enable the antenna to be aimed and to be held steady in a predetermined position.

SUMMARY OF THE INVENTION

In accordance with the invention, the structure associated with the antenna is mounted at three points on the steering mounting, which latter rests on the ground, with that one of the points which is situated at the apex of the structure being provided with a bi-directional joint which allows the antenna to pivot about an axis XX in azimuth and an axis YY in elevation, which axes lie orthogonally to one another in a plane perpendicular to the axis ZZ of the antenna, the said bi-directional joint being mounted to pivot on the base mounting about the axis ZZ of the antenna itself.

In accordance with a feature of the invention, the steering mounting is formed by a triangular-based pyramid which rests on the ground at three points and the apex of which supports, via the bi-directional joint, the apex of the antenna structure, the said mounting having at its front face two jacks which are hinged at the bottom to two of the points at which the mounting is supported and which are connected at the top to the antenna structure, the top of one of the said jacks being connected by a hinged link-rod to the bottom of the other strut.

The mounting may be adapted to the latitude of the place at which the station is situated by adjusting the length of only one of the members making up the base. The range of adaption extends from latitude 0° to latitude 90°. Within each setting there is a fine adjustment of ± 3°.

In accordance with a first possible manner of use, the mounting is set up so that its axis of symmetry lies north/south.

When this is the case, the antenna may be aimed at a satellite which is situated ± 15° away from the station in longitude by adjusting fixed tubular arms which form extensions of the jacks, the travel of the jacks continuing to provide ± 5° of steering capability relative to the selected centre-line position.

When the difference in longitude between the station and the satellite is more than 15°, the mounting is sited differently, its axis of symmetry no longer being orientated north/south but rather its position-sensing system being orientated north/south so as to provide a check on position with reference to an equatorial system.

This being so, the antenna may be trained at satellites situated down as far round as the limit set by the horizon. If it is necessary to transfer to a satellite which is more than 15° away from the original position, it will be necessary to alter the way in which the mounting is sited on the ground. This operation is very easy to perform by shifting the mounting round, which takes very little time.

Producing the mounting from tubular members makes it possible to obtain a piece of equipment which is not very bulky and which is easy to move and assemble.

BRIEF DESCRIPTION OF THE DRAWINGS

Other objects and advantages of the invention will become apparent from reading the following description and from the accompanying drawings, which show one embodiment thereof by way of example only and in which:

FIG. 7 is a cross-sectional view of the way in which the foot of a jack is mounted on a swivel joint, FIG. 8 is a view of the head of a jack.

SPECIFIC DESCRIPTION OF PREFERRED EMBODIMENT

Figure 1:
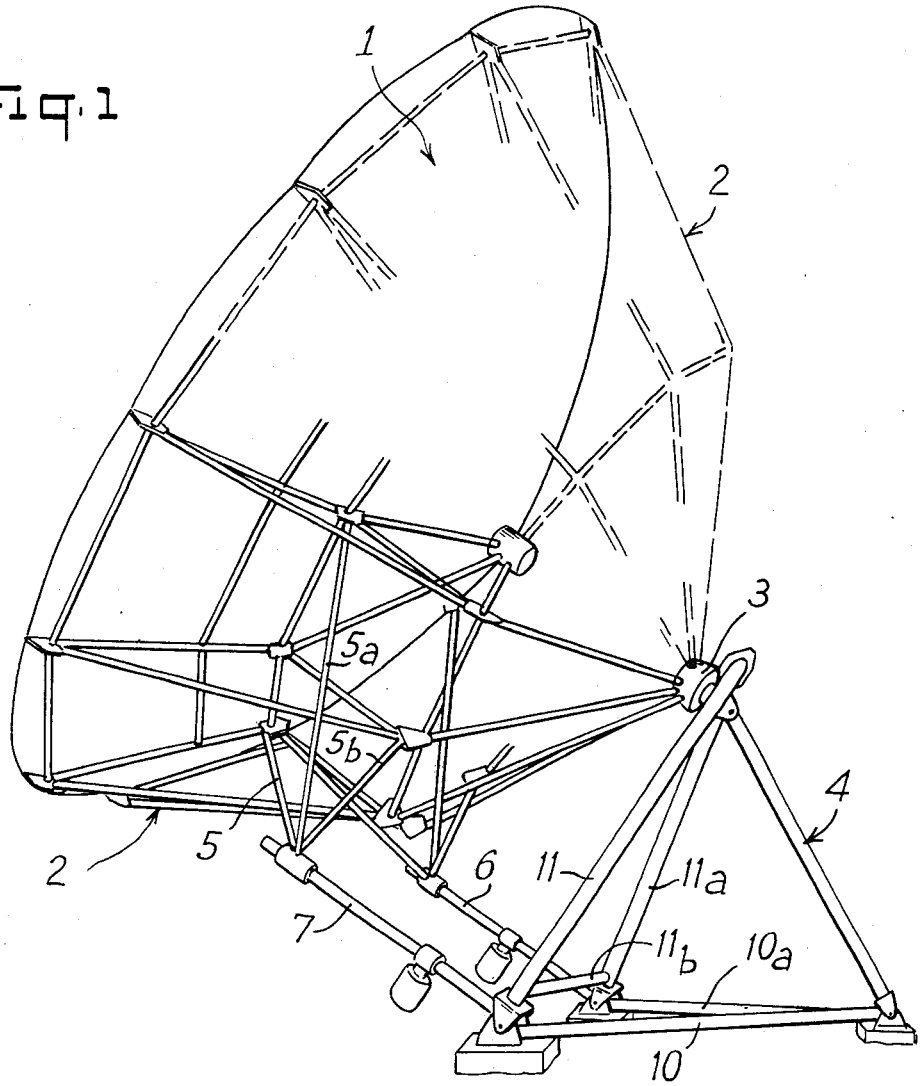
FIG. 1 is a schematic, perspective view of an antenna and of the mounting for it according to the invention.
Figure 2:
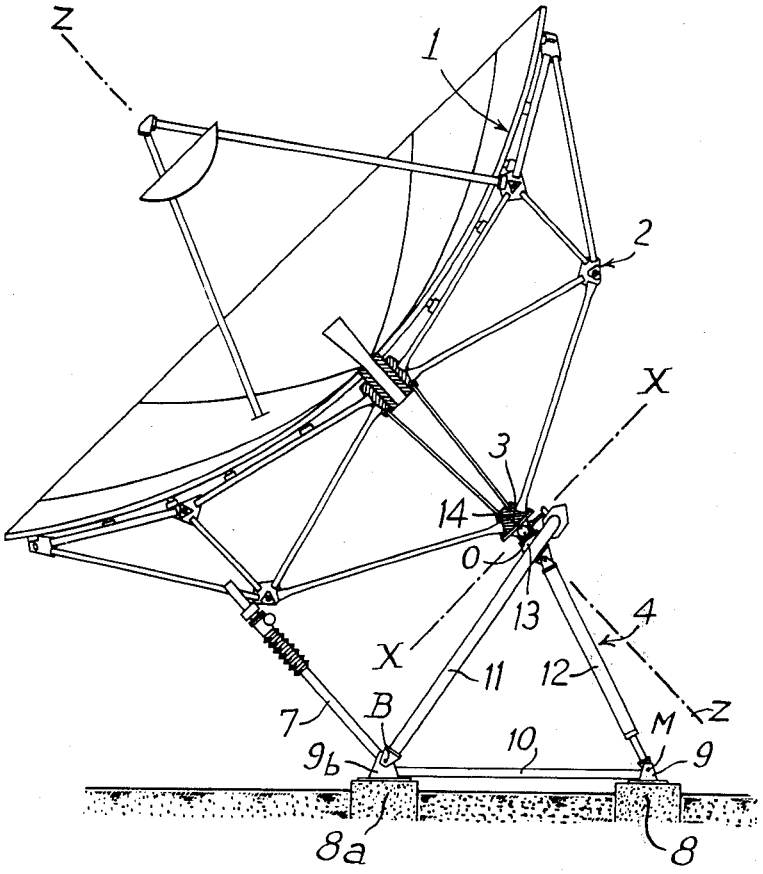
FIG. 2 is a view of the antenna and its mounting in side elevation.
Figure 3:
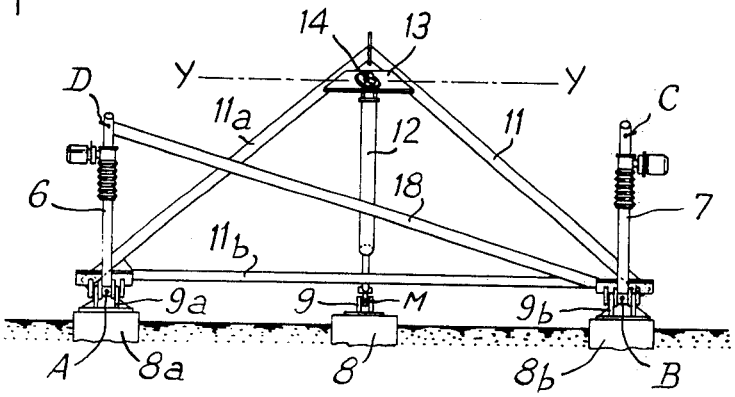
FIG. 3 is a view of the mounting in front elevation.

Referring now to the drawings, in FIGS. 1 and 2 is shown a telecommunications antenna which includes a reflector assembly 1 which is mounted on a reticulate structure 2 which is made up of tubular members. The apex 3 of the structure rests on a steering mounting 4 and two sets of tripod arms such as 5, 5*a*, 5*b* rest on two jacks 6 and 7 which are hinged to the base (FIGS. 2 and 3).

The mounting 4 is in the form of a pyramid and its triangular base rests on three concrete blocks 8, 8*a* and 8*b*. The blocks carry brackets such as 9, 9*a*, 9*b* to which are attached tubular members 10 forming the base and a triangular member 11, 11*a*, 11*b* is hinged to the brackets by shafts A and B.

At the rear the triangular member is supported, via a pillar 12 of adjustable length, on a bracket 9 which carries a shaft M to which the bottom of the said pillar 12 is hinged. The triangular member 11, 11*a*, 11*b* bears a plate 13, on which a bi-directional joint 14 is so mounted as to be capable of rotating about the axis ZZ of the antenna. Joint 14 may in particular be formed by a universal joint and on it rests the apex 3 of the structure 2 associated with the antenna. The bi-directional mounting enables the antenna to pivot about an axis XX in azimuth and an axis YY in elevation, the said axes being orthogonal one to another and lying in a plane perpendicular to the axis ZZ of the antenna.

What is more, since the bi-directional joint 14 is mounted on the apex of the mounting 4 so as to be able to rotate, the antenna is also capable of turning on its own axis ZZ. To brackets 9*a* and 9*b* are hinged, by means of shafts A and B, jacks 6 and 7, each of which is provided at the bottom with a bush 15 (FIG. 7) which is held in place by a circlip 16 and which contains a part-spherical area which co-operates with a corresponding part-spherical area provided on shafts A and B in such a way as to form a swivel joint which allows the jack to move in a number of planes.

The antenna is held steady by the two jacks 6 and 7, which, via swivel joints, connect the two points C and D (which are secured to the structure by sets of tripod arms such as 5, 5*a*, 5*b*) to the two points A and B in the mounting.

In addition to connecting the antenna to its support in this way, end D of jack 6 is connected to the base B of jack 7 by a link-rod 18 which is swivel mounted at either end.

Each jack 6 and 7 contains a rod 19 which has a threaded part 20 at its end (FIG. 8) onto which is screwed a nut 21 which is captive in an end-piece 22 which is able to slide on rod 19, the said nut being actuated by a worm 23 which is operated by drive means of any kind which are not shown in the drawing.

To the end-piece 22 are attached the members 5, 5*a*, 5*b* forming the set of tripod arms and in the case of strut 6 the end-piece has hinged to it at 24 the link-rod 18.

It will be apparent to those skilled in the art that the jacks could be of any other type and in particular could be of the hydraulic type.

The device according to the invention operates as follows:

The orientation of the antenna is controlled by the jacks 6 and 7 which act on two points C and D (FIG. 4) external to the symmetrical structure associated with the antenna. These points are connected to the antenna by tripods whose three legs are shown at 5, 5*a*, 5*b* which legs are joined to main intersections in the structure.

In a first case, where the station is less than 15° away from the satellite in longitude, jacks 6, 7 are operated simultaneously in the same direction to rotate the antenna about its axis of elevation YY. If the struts are operated simultaneously in opposite directions, the antenna is made to rotate about its axis in azimuth XX.

Within this angle of 15° changes in centre-line orientation are made by adjusting the fixed parts of the jacks. Any adjustment which may be needed to the inclination of the polar axis ZZ is made by adjusting the length of pillar 12.

In a second case, where the station is more than 15° away from the satellite in longitude, jacks 6 and 7 are used independantly of one another. The plate 13 which carries the fixed part of the bi-directional joint 14 is inclined in such a way that the axis in azimuth XX is tilted relative to the plane which bisects the angle formed with the front triangular member 11, 11*a*, 11*b* of the mounting, although the axis in azimuth XX is still contained within plane O B D.

This being so, the movement of either jack 6, 7 causes rotations about both the axes, but the evidence of these rotations refers to an equatorial co-ordinate system. Thus, to make good a difference in longitude only, it is necessary to act on both jacks 6, 7 at once. When this is done one of the two jacks makes the change in longitude, but it also makes an alteration in latitude, which is an error and is made good by the other jack.

In the special case where axis XX coincides with one of the members 11, 11*a* which are part of the front triangle of the mounting, the movement of one or other jack causes rotation about either XX or YY alone.

If in the course of operations it becomes necessary to communicate with another satellite which is more than 15° away from the first in longitude, it is necessary to alter the way in which the mounting is sited. In this event, it is merely necessary to shift the jacks 6 and 7 to move them to a new position and to swing the mounting around the rear pillar 12. All that is needed is to provide two new blocks 8*a*, 8*b* which are differently orientated and to move the bottom of the jacks to these new blocks with block 8 serving as a pivot.

To rotate the antenna about equatorial axes a device for operating the jacks sequentially may be used.

Figure 4:
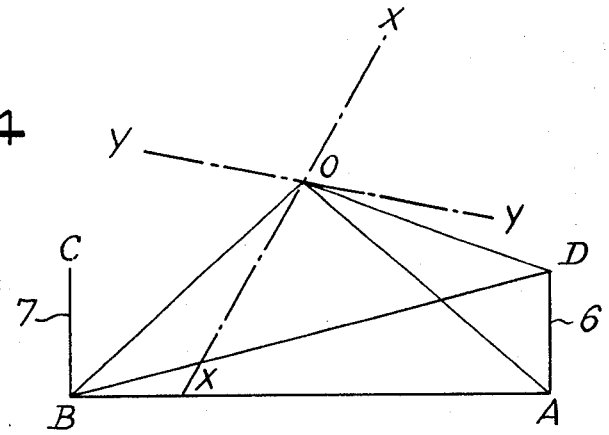
FIG. 4 is a schematic view of the mounting from the rear.

If the action of either jack is considered independantly of the other FIG. 4) it can be seen that:

Jack 6 causes rotation about O B.

Jack 7 causes rotation about axis O D.

Figure 5:
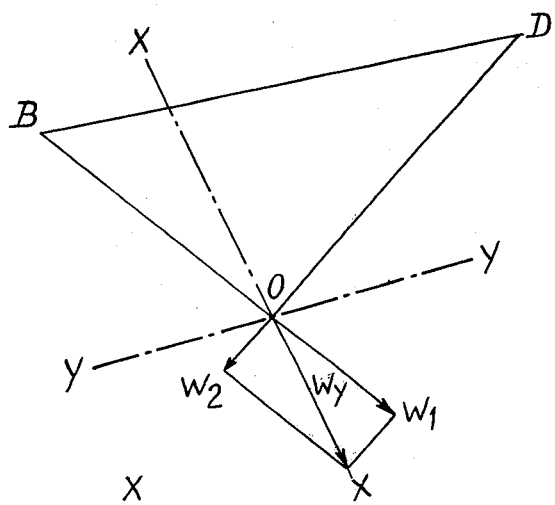
FIG. 5 is a diagram showing rotation about the azimuth axis XX.
Figure 6:
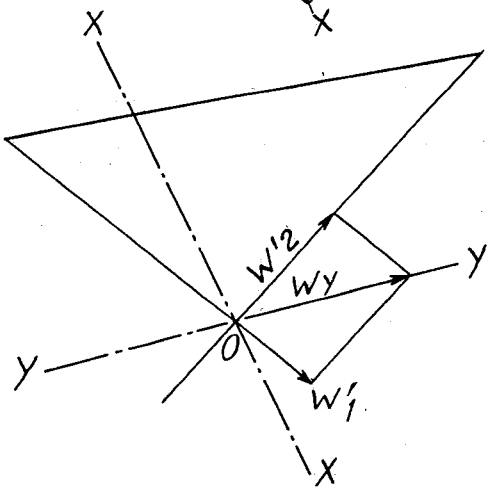
FIG. 6 is a diagram showing rotation about the elevation axis YY.

In plane O B D, these rotations may be represented by vectors W1 and W2 the resultant of which is contained in plane O D B and is a rotation Wy (FIG. 5). To cause this vector to coincide with the axis in azimuth about which it is desired that the antenna should turn, it is necessary to set conditions for the relationship W1/W2 as regards sign (direction of rotation) and absolute value.

Within very small operating tolerances, this ratio should be constant $W1/W2 = K$ If the greater of the two values W1 and W2 is equivalent to the appropriate jack operating normally, the other jack needs to cause a smaller rotation, for example: $W2 = W1/K$.

To achieve this result in an economical manner, a sequential control device situated in the control box for the jacks allows time/space ratios to be adjusted at will.

Figure 9:
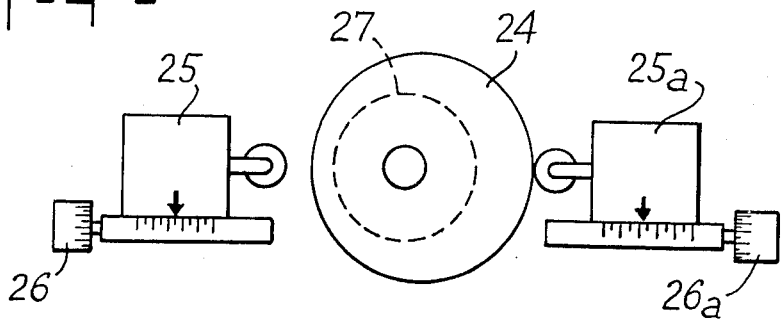
FIG. 9 is an elevation view of a device for controlling the jacks.

It consists of a small auxiliary motor 27 which through a reduction unit turns a cam 24 (FIG. 9). The cam operates a micro-switch 25 which is opened and closed for periods which vary as a function of its position in relation to the cam's centre of rotation. The position of the micro-switch can be adjusted by means of a micrometer screw 26. This produces a "step by step" operating sequence in which the steps are successive and equal and their average value corresponds to the desired operating speed.

The size of the maximum errors in terms of space traversed is determined by the permitted aiming error for the reflector. To cause the antenna to turn about the axis YY which is perpendicular to axis XX, it is necessary this time to set conditions for the ratio $K' = W'1/W'2$. Beginning with the greater of the values W'1 and W'2, which corresponds to one of the jacks operating continuously, the value and sign of the lesser movement of rotation are adjusted by adjusting the times for which a micro-switch 25*a* is open and closed. Since these values are not the same for rotations about XX and YY it is necessary to have two microswitches 26, 25*a*, but only one cam 24 is needed. The microswitches of course control the motors for operating the jacks 6, 7.

I claim:

1. A steering mounting for a telecommunication antenna used to track a geostationary satellite, said mounting comprising a recticulate rigidifying structure including a generally symmetrical frame having an apex support point, a reflector assembly secured to said rigidifying structure, and means for supporting said reticulate structure on the ground, said supporting means including means for supportingly engaging said reticulate structure at three points, one of said points being situated at the apex of said reticulate structure, said means for supportingly engaging said reticulate structure including bi-directional joint means at said apex for allowing the reticulate structure to pivot at the apex about an axis XX in azimuth and an axis YY in elevation, said axes lying orthogonally to one another in a plane perpendicular to the axis ZZ of symmetry of the reticulate structure, and means mounting said bi-directional joint means on said supporting means for pivotal movement thereon about the axis ZZ.

2. A steering mounting according to claim 1, wherein said supporting means comprises a triangular-based pyramid frame resting on the ground at three points and having an apex at which said means for mounting said bi-directional joint means is located adjacent the apex of the reticulate structure of the antenna, said supporting means including two extensible jacks respectively pivotally mounted at one end at two corners of said pyramid frame and at their opposite ends to said reticulate structure at the other of said three points, and an elongated link pivotally connected at one end to one of said jacks adjacent the said other end thereof and to the other of said jacks adjacent its said one end.

3. A steering mounting according to claim 2 wherein said reticulate structure includes a pair of tripod frame elements respectively connected to said jacks at said opposite ends thereof.

4. A steering mounting according to claim 2 wherein said pyramid frame is formed by three tubular elements, one of which, located at the other of the corners of said pyramid frame from said jacks, is adjustable in length.

5. A steering mounting according to claim 2, wherein said bi-directional joint means by which the apex of said reticulate structure is supported comprises a universal joint.

6. A steering mounting according to claim 2 including means for controlling said jacks comprising motors and sequential control means including two micro-switches and rotationally driven cam means, the position of said micro-switches being adjustable relative to said cam means.

7. A steering mounting according to claim 2, wherein the sequential operation of the jacks by said motor and switches causes rotational movement which, in combination, allows the antenna to be rotated about said XX, YY and ZZ axes, whereby said antenna is positionable anywhere in space from the apex of the reticulate structure.

* * * * *